US005769627A

United States Patent [19]

Chisaki et al.

[11] Patent Number: 5,769,627

[45] Date of Patent: Jun. 23, 1998

[54] VERTICAL TYPE CALCINATION KILN

[75] Inventors: Tatsu Chisaki, Kawaguchi; Daizo Kunii, Tokyo, both of Japan

[73] Assignee: Chisaki Co., Ltd., Tokyo, Japan

[21] Appl. No.: 659,840

[22] Filed: Jun. 7, 1996

[30] Foreign Application Priority Data

Jun. 9, 1995 [JP] Japan ..... 7-167123

[51] Int. Cl.[6] ..... F27D 1/08

[52] U.S. Cl. ..... 432/95; 432/98; 432/101; 432/138; 432/139

[58] Field of Search ..... 432/95, 96, 98, 432/99, 101, 138, 139

[56] References Cited

U.S. PATENT DOCUMENTS 2,503,555 4/1950 Lykken ..... 432/95
4,254,221 3/1981 Beckenbach ..... 432/95
4,507,079 3/1985 Nagl ..... 432/95
4,747,355 5/1988 Berkum ..... 110/281
4,747,773 5/1988 Predescu et al. ..... 432/95

*Primary Examiner*—Henry A. Bennett
*Assistant Examiner*—Jiping Lu
*Attorney, Agent, or Firm*—Evenson, McKeown, Edwards & Lenahan, P.L.L.C.

[57] ABSTRACT

A storage device 23 for storing a raw material to be calcined is provided at a position above a kiln cover 1, and the storage device 23 is connected to a preheating space 22 in such a manner as to be capable of dropwise supplying the raw material into the preheating space 22 by means of a raw-material supplying pipe 26. An airtight supplying mechanism 24 for dropwise supplying the raw material in a state in which the influx of air from the outside is prevented is provided between the storage device 23 and the raw-material supplying pipe 26.

19 Claims, 9 Drawing Sheets

VERTICAL TYPE CALCINATION KILN

BACKGROUND OF THE INVENTION

1. Field of the Invention

The present invention is used in a technical field for obtaining products by calcinating under a high temperature a granular or lump-like raw material (hereafter referred to as the raw material) such as pellets which are made by mixing and forming minerals, e.g., limestone, dolomite, and magnesite, or various inorganic substances, and particularly concerns a vertical kiln for calcination therefor.

2. Description of the Related Art

As a vertical type calcination kiln of this type, one disclosed in Japanese Patent No. 1200742 (Japanese Patent Publication No. 58-32307) is known. In this known kiln for calcination, an annular rotating hearth which rotates about a vertical axis is provided below a kiln cover, a raw material to be calcinated is dropwise supplied to a preheating space on the rotating hearth through a raw-material supplying pipe for supplying the raw material from the outside, thereby forming a primary deposited layer of raw material. The primary deposited layer forms an upper free surface on the raw-material supplying pipe side and a lower free surface facing a combustion chamber, respectively, at angles of repose. The raw material is heated by heat transfer by radiation from the high-temperature flames and combustion gases in the combustion chamber with respect to the lower free surface of the primary deposited layer facing the combustion chamber formed in a central space portion of the rotating hearth immediately below the kiln cover, and by convectional heat transfer from the combustion gases which flow upwardly through the primary deposited layer and flow out to the upper free surface, thereby attaining calcining by 50 to 60% or thereabouts (half-calcination). Then, the half-calcined raw material is dropped from a drop port formed in the central portion of the hearth by the operation of a plurality of pushers disposed around the kiln. A secondary deposited layer of the half-calcined raw material is formed in a lower space of a cylindrical kiln body provided in such a manner as to extend downward and continue from the hearth, and complete calcination is effected there. A diffuser and an ejector are disposed in a central portion of the kiln body. The diffuser has a vertical hollow cylindrical shape, and a gas-flowing duct is formed therein in the manner of a through duct such that its inside diameter becomes greater toward its upper portion in a tapered manner. The ejector for ejecting air for combustion from the outside faces a lower opening of the diffuser. The secondary deposited layer of the half-calcined raw material which has dropped from the hearth to the kiln body is formed on the outer periphery of the diffuser and reaches the vicinity of an upper end of the diffuser. The secondary deposited layer forms the upper free surface facing the combustion chamber at an upper-end outer periphery of the diffuser and the lower free surface around the ejector on the inner side of the lower end of the diffuser, respectively, at angles of repose. According to the above-described diffuser and ejector, when the air is ejected from the ejector toward the gas-flowing duct of the diffuser, the pressure in the region of the lower free surface formed around the ejector in the secondary deposited layer formed around the diffuser becomes low, so that part of the combustion gases in the combustion chamber is induced into the secondary deposited layer from the upper free surface of the secondary deposited layer formed around the upper-end outer periphery of the diffuser, and flows downwards toward the lower free surface. Accordingly, this secondary deposited layer is calcined completely by the flowing combustion gases and is formed as products. The products are allowed to drop from a discharge port at the bottom of the kiln body, and are discharged therefrom. At that time, the products are cooled by air which flows into the kiln body through the discharge port and by the air which flows through the ejector.

However, with the above-described conventional calcination kiln, when the raw material is dropwise supplied through the supplying pipe toward the surface of the primary deposited layer on the hearth, a large amount of air flows into the kiln from the outside together with the raw material. Consequently, the air which has flowed in from the outside is mixed with the combustion gases which flow from the combustion chamber into the primary deposited layer on the hearth and are discharged to the outside after flowing out from the upper free surface of the primary deposited layer. In a case where a carbon dioxide gas which is the principal combustion gas generated during calcination needs to be taken out as it is with a high concentration, the aforementioned mixing of air causes a decline in the concentration of the carbon dioxide gas, and is therefore undesirable.

In addition, in a case where the concentration of the carbon dioxide gas which is taken out may remain low, burning is sometimes carried out by using excess air of a large value so as to control the temperature of the interior of the combustion chamber to a low level.

If the fuel is burned by using such excess air of a large value, the temperature of the combustion gases which are discharged upwardly from the primary deposited layer on the hearth in the calcination kiln becomes high. Consequently, the amount of thermal energy fetched to the outside by the discharged combustion gases becomes large, so that there occurs a drawback in that the value of the fuel consumption rate (the quantity of heat necessary for calcination of a unit quantity of raw material) for calcination of the raw material increases.

In addition, in the above-described publicly known calcination kiln, a gaseous or liquid fuel is burned after being supplied from a fuel supplying pipe into the combustion chamber., but it is impossible to use combustibles in powder and granular form and in pieces, such as petroleum coke including coarse particles, powdery coal, crushed plastic pieces, crushed plant and wood pieces. If, in particular, the aforementioned crushed pieces, which need large disposal cost as controlled-type wastes, can be used, it is possible to ensure environmental protection and effect a substantial decline in the fuel cost, but this advantage cannot be made use of.

Further, with the above-described known calcination kiln, the diffuser and the ejector are used to more effectively calcine the half-calcined raw material in the secondary deposited layer. However, if the air for combustion from the outside is ejected from the ejector, the pressure in the region of the lower free surface of the secondary deposited layer around the ejector declines as described before. Consequently, the air flowing into the kiln body through the discharge port for the products flows toward the lower free surface, and the amount of influx of the combustion gases from the upper free surface of the secondary deposited layer facing the combustion chamber is reduced, with the result that the effect of calcination cannot be expected much.

SUMMARY OF THE INVENTION

A primary object of the present invention to provide a vertical kiln for calcination which makes it possible to prevent the influx of air from the outside through the raw-material supplying pipe, to control the temperature of the interior of the combustion chamber without using excess air sufficient for combustion, and to control the concentration of carbon dioxide taken out, thereby overcoming the above-described problems.

A second object of the present invention is to utilize powder and granular combustibles including solid wastes. A third object of the present invention is to improve the thermal efficiency in the combustion chamber by making use of the heat of the combustion gases to be exhausted, and promote calcination by actively effecting the circulation of the combustion gases in the secondary deposited layer which is calcined in the kiln body, thereby improving the thermal efficiency. Further, a fourth object of the present invention is to make uniform the circulation of the combustion gases in the primary and secondary deposited layers by making uniform the distribution of particle sizes of the raw material in the primary deposited layer.

In accordance with the present invention, the above-described primary object is attained by a vertical type calcination kiln comprising an annular hearth adapted to rotate about a vertical axis and having in a central portion thereof a drop port for dropping a raw material; and a kiln cover disposed fixedly at a position above the hearth, wherein an inner hollow cylindrical portion having an outside diameter larger than a diameter of the drop port and provided continuously from the kiln cover, and an outer hollow cylindrical portion connected at an upper portion thereof to the inner hollow cylindrical portion are provided around the kiln cover, the outer hollow cylindrical portion being formed in such a manner as to extend more downwardly than the inner hollow cylindrical portion, a fuel supplying port being provided in the kiln cover for supplying a fuel from the outside into a combustion chamber formed immediately below the kiln cover, a sealing device which is airtight with the outside being provided between the hearth and a lower end of the outer hollow cylindrical portion so as to permit relative rotation of the hearth with respect to the kiln cover, a raw-material supplying pipe being provided in an annular preheating space formed by being surrounded by the hearth and the inner hollow cylindrical portion and the outer hollow cylindrical portion connected to each other at upper portions thereof so as to dropwise supply the raw material from the outside into the preheating space, the preheating space being open radially inwardly so as to communicate with the combustion chamber, a kiln body of a vertical hollow cylindrical shape being provided in such a manner as to extend downward from a rim portion of the drop port formed in the central portion of the hearth, the raw material in the preheating space being adapted to drop from a side facing the combustion chamber, a discharge port-being formed in a lower portion of the kiln body for discharging as a product the raw material calcined in the kiln body after being dropped from the drop port, the vertical type calcination kiln characterized in that a storage device for storing the raw material to be calcined is provided at a position above the kiln cover, that the storage device is connected to the preheating space in such a manner as to be capable of dropwise supplying the raw material into the preheating space by means of the raw-material supplying pipe, and that an airtight supplying mechanism for dropwise supplying the raw material in a state in which the influx of air from the outside is prevented is provided between the storage device and the raw-material supplying pipe. In this case, the airtight supplying mechanism is preferably a rotary valve, in which case the storage device may be divided into an upper storage device and a lower storage device, and the rotary valve may be provided therebetween.

To effectively control the temperature of the interior of the combustion chamber and the concentration of carbon dioxide to be taken out, an upper portion of the preheating space and the combustion chamber may be connected to each other by a combustion-gas introducing pipe for forming a feedback passage whereby part of combustion gases flowing through the raw material in the preheating space and exhausted upward can be fed back to the combustion chamber. Alternatively, an upper space of the preheating space may be divided into an inner space and an outer space by means of a hollow cylindrical partitioning wall which is suspended downward between the inner hollow cylindrical portion and the outer hollow cylindrical portion to an intermediate position in the preheating space, and the raw-material supplying pipe is connected to one of the inner space and the outer space, while the combustion-gas introducing pipe is connected to another one thereof.

Next, the second object of the present invention is attained by a vertical type calcination kiln wherein a solid-fuel supplying port capable of supplying a solid combustible substance into the combustion chamber communicates with the combustion chamber and/or a combustion-gas supplying pipe.

Further, the third object of the present invention is attained by a vertical type calcination kiln wherein a combustion-air supplying pipe for receiving air for combustion from the outside is connected to the combustion chamber, and the combustion-air supplying pipe is connected to the combustion chamber via a heat exchanger whereby the air in the combustion-air supplying pipe undergoes heat exchange with the combustion gas in the combustion-gas introducing pipe, or by a vertical type calcination kiln wherein the kiln body is provided in an interior thereof with a hollow cylindrical diffuser supported by the kiln body and having an air-supplying duct formed therein in the manner of a vertically extending through duct with its inside diameter becoming greater toward its upper portion, an ejector having an ejection port facing a lower-end opening of the air-supplying duct in the diffuser so as to upwardly eject air for combustion received from the outside with respect to the air-supplying duct, and a rotary joint capable of rotating in an airtight state with respect to an air-supplying pipe for supplying the air for combustion from the outside, and wherein a circumferentially communicating annular space is formed in a hollow cylindrical wall of the diffuser, and the rotary joint has its inner space connected to a portion of the annular space of the diffuser by means of a first pipeline, while another portion of the annular space is connected to a lower portion of the ejector by means of a second pipeline. In that case, it is more effective if a discharge cylinder provided with narrow drop passages having an area narrower than that of a space in a cross section of the kiln body above a position of the rotary joint is provided below the kiln body between the position of the rotary joint in the kiln body and the discharge port in such a manner as to permit the rotation of the kiln body in an airtight state with respect to the kiln body.

In addition, the fourth object is attained by a vertical type calcination kiln wherein the storage device has below the airtight supplying mechanism a rotary chute which rotates about the vertical axis, and an inlet side of the rotary chute is disposed at a position for receiving the raw material dropping from the airtight supplying mechanism arranged on the vertical axis, while an outlet side thereof is disposed at a position offset radially outwardly of at least the vertical axis. In that case, if the storage device is provided with an inducing device disposed below the airtight supplying mechanism so as to induce the air in the storage device toward the outside, even if slight air leaks and flows into the airtight supplying mechanism during the supplying of the raw material, the air which has flowed in can be induced so as to ameliorate the situation.

In the above-described invention, when the raw material is supplied from the storage device into the preheating space through the raw-material supplying pipe, the raw material drops through the airtight supplying mechanism, so that the influx of air from the outside is prevented.

The raw material which is charged into the preheating space and dropped onto the hearth forms a primary deposited layer in the preheating space, and is set in a half-calcined state by radiant heat transfer from flames and the combustion gas as well as by convectional heat transfer from the combustion gas which flows into the primary deposited layer from the lower free surface, and flows upward therethrough to the upper free surface.

The half-calcined raw material drops into the kiln body through the drop port in the hearth by the action of pushers and the like, and forms the secondary deposited layer in the kiln body where the raw material is calcined completely. The completely calcined raw material is cooled by undergoing heat exchange with combustion air supplied from below, and is discharged as a product through the discharged port at the bottom.

In a case where a solid combustible substance is also to be used as fuel, the solid combustible substance is supplied through the solid-fuel supplying port.

When the temperature of the interior of the combustion chamber needs to be controlled, or the concentration of carbon dioxide to be taken out should be controlled, part of the combustion gas to be exhausted from the preheating space is fed back to the combustion chamber.

To increase the temperature of the combustion air received from the outside by making use of the heat of the combustion gas, the air is heated by being subjected to heat exchange with the combustion gas by a heat exchanger.

In the case where the differ and the ejector are provided in the kiln body, the air from the outside supplied to the rotary joint is heated in the annular space in the diffuser, and is then ejected into the combustion chamber.

In the case where the discharge cylinder which forms narrow drop passages is provided, the secondary deposited layer in the kiln body exhibits large resistance with respect to air which flows in from the discharge port and passes through particles and lumps of the calcined material, so that the combustion gas from the combustion chamber is effectively introduced into the secondary deposited layer from the upper free surface thereof.

In the case where the rotary chute is provided below the airtight supplying mechanism, the raw material is deposited uniformly in the circumferential direction, so that the raw material is calcined uniformly.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the preferred embodiments of the present invention.

First Embodiment

Figure 1:
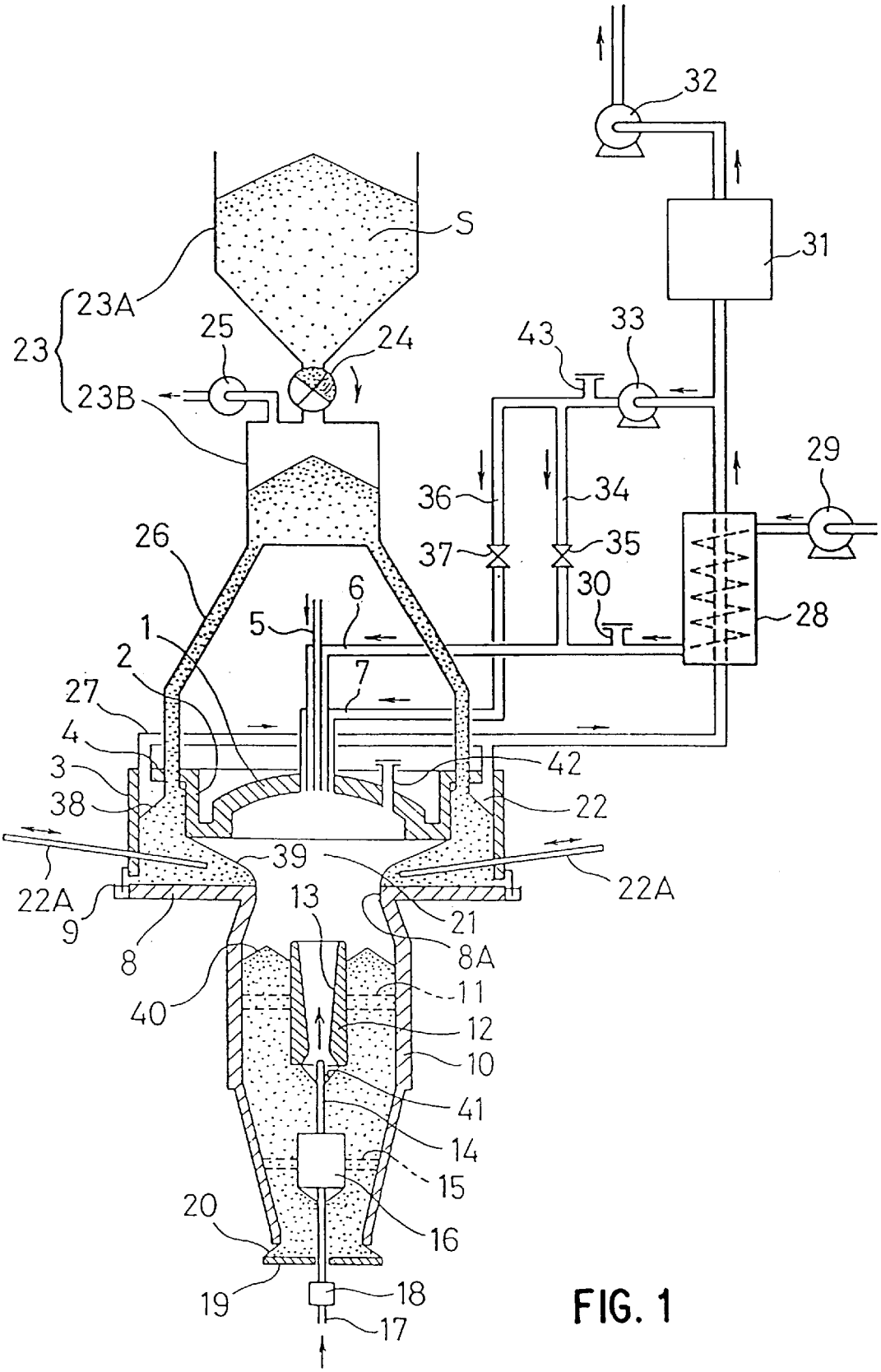
FIG. 1 is a vertical cross-sectional view of the apparatus in accordance with a first embodiment of the present invention.

In FIG. 1, reference numeral 1 denotes a kiln cover formed of a heat resisting material. An inner hollow cylindrical portion 2 is provided continuously at the outer periphery of the kiln cover 1, and an outer hollow cylindrical portion 3 is provided on the outer side of the inner hollow cylindrical portion 2. Both the inner hollow cylindrical portion 2 and the outer hollow cylindrical portion 3 are connected to each other at their upper portions by means of a connecting portion 4, and the outer hollow cylindrical portion 3 extends more downwardly than the inner hollow cylindrical portion 2.

A burner 5 for feeding a gas or liquid fuel from the outside is provided in a central portion of the kiln cover 1. A combustion-air supplying pipe 6 and a burning-gas supplying pipe 7 serving as a combustion-gas feedback passage, which will be described later, are provided around the burner 5.

An annular plate-shaped hearth 8 formed of a heat resisting material is rotatably provided below the kiln cover 1. The hearth 8 is rotated by an unillustrated external driving device. A sealing device 9 for providing an airtight seal between an outer peripheral edge of the hearth 8 and a lower end of the outer hollow cylindrical portion 3, e.g., a known water seal, is provided therebetween. The hearth 8 is allowed to rotate while airtightness is being maintained with respect to the outside by means of the sealing device 9. A drop port 8A is formed in a central portion of the hearth 8, and a kiln body 10 having a vertical hollow cylindrical shape is formed continuously downward from a peripheral edge of the drop port 8A. In the case of this embodiment, the kiln body 10 itself becomes narrower toward its lower portion. A diffuser 12 is provided in an upper position inside the kiln body 10 by means of a support 11 provided in the kiln body 10. The diffuser 12 has a vertical hollow cylindrical shape, and an air-supplying duct 13 is formed therein in the manner of a through duct such that its inside diameter becomes greater toward its upper portion. An ejector 14 is disposed in such a manner as to face a lower opening of the diffuser 12. The ejector 14 is connected to a heat exchanger 16 supported by a support 15 of the kiln body 10. A lower portion of the ejector 14 is located outside the kiln, and communicates with an air-supplying pipe 17 for supplying air from the outside, by means of a rotary joint 18 which permits relative rotation with respect to the air-supplying pipe 17. A bottom plate 19 through which the lower portion of the ejector is passed is located on the bottom of the kiln body 10. A discharge port 20 is formed between the bottom plate 19 and a lower end of the kiln body 10.

A combustion chamber 21 is formed immediately below the kiln cover 1, and an annular preheating space 22 is formed by the inner hollow cylindrical portion 2, the outer hollow cylindrical portion 3, the connecting portion 4, and the hearth 8 in such a manner as to surround the combustion chamber 21. The preheating space 22 is open in its radially inward portion toward the combustion chamber 21. Pushers 22A formed in the shapes of rods are provided in the preheating space 22 in such a manner as to penetrate the outer hollow cylindrical portion 3 from the outer side, and are adapted to reciprocate, as necessary, in the radial direction of the kiln (in the longitudinal direction of each rod).

A storage device 23 is disposed at a position above the kiln cover 1 for storing in advance a raw material to be calcined, e.g., such minerals as limestone, dolomite or magnesite, or pellets which are made by mixing and pelletizing some of the above inorganic substances. In the case of this embodiment, the storage device 23 has an upper storage device 23A and a lower storage device 23B, which are connected to each other by means of a rotary valve 24 having an airtight supplying mechanism. Connected to an upper portion of the lower storage device 23B is an inducing device 25, such as a blower, for ensuring that the pressure of the air inside the lower storage device 23B is set substantially equal to the pressure of the space in the upper portion of the preheating space 22. In the case of this embodiment, the rotary valve 24 is divided into four chambers, and as the rotary valve 24 rotates, one of the chambers which is located at an upper position receives a raw material S from the upper storage device 23A. As the rotary valve 24 further rotates, when that chamber is located at a lower position, the raw material S is allowed to drop into the lower storage device 23B. Thus the lower storage device 23B is shielded from the outside air.

A plurality of raw-material supplying pipes 26 for dropwise supplying the raw material from the lower storage device 23B into the preheating space 22, as well as a combustion-gas introducing pipe 27 for introducing a combustion gas from an upper portion of the preheating space 22, are connected to the connecting portion 4 which forms an upper wall of the preheating space 22.

The combustion-air supplying pipe 6 connected to the kiln cover 1 receives air from the outside by means of a blower 29 via a heat exchanger 28, and supplies the air into the combustion chamber 21. In addition, the combustion-air supplying pipe 6 is provided with a solid-fuel supplying port 30 for supplying a combustible substance in the form of powder or granules, as required, into the combustion chamber 21 together with air. The combustion-gas introducing pipe 27 is connected to a blower 32 via the heat exchanger 28 and a dust collector 31. The combustion gas which is discharged from the preheating space 22 is exhausted to the outside after the temperature of the combustion air induced by the blower 29 is raised by the heat exchanger 28 while the temperature of the combustion gas itself is lowered, and after powdery dust is separated from the combustion gas by the dust collector 31.

The combustion-gas introducing pipe 27 is branched off at a position between the heat exchanger 28 and the dust collector 31, so that part of the combustion gas with their temperature lowered is taken in by a blower 33. The branched pipe is further branched at a position downstream of the blower 33, and one branch pipe 34 converges with the combustion-air supplying pipe 6 via a valve 35, while another branch pipe 36 is connected to the kiln cover 1 through the combustion-gas supplying pipe 7 via a valve 37.

In the apparatus of this embodiment arranged as described above, the raw material is calcined in the following procedure.

(1) While the influx of air from the outside is being prevented by the rotary valve 24, the raw material is dropped from the upper storage device 23A and is stored in the lower storage device 23B.

(2) There are cases where air slightly leaks and flows into the lower storage device 23B through a gap between each rotary blade of the rotary valve 24 and a fixed case. In such a case, the air inside the lower storage device 23B is induced by the inducing device 25, such as a blower, so that its pressure becomes substantially equal to the pressure in the upper space of the preheating space 22. At that juncture, if part of the combustion gas flows into the lower storage device 23B from the preheating space 22, the combustion gas is induced to the outside together with the air inside the lower storage device 23B.

(3) The raw material in the lower storage device 23B drops through the raw-material supplying pipe 26, and forms a primary deposited layer of raw material on the hearth 8 which forms the bottom of the preheating space 22. This primary deposited layer forms an upper free surface 38 on the raw-material supplying pipe 26 side and a lower free surface 39 on the combustion chamber 21 side, respectively, at angles of repose.

(4) The fuel which is jetted out from the burner 5 is burned in the combustion chamber 21 by an air flow sent to the vicinity of the tip of the burner 5 through the combustion-air supplying pipe 6, and heats the lower free surface 39 of the primary deposited layer by radiant heat transfer from the flames and combustion gas. The combustion gas passes by the lower free surface 39 of the primary deposited layer from the combustion chamber 21, flow through the interior of the primary deposited layer, and heats the raw material in the primary deposited layer by convectional heat transfer. Thus, the raw material in the vicinity of the lower free surface 39 is half-calcined.

(5) The plurality of pushers 22A, which are capable of reciprocating in the radial direction of the kiln while being guided by the outer hollow cylindrical portion 3, are disposed around the outer hollow cylindrical portion 3. As the pushers 22A are operated, the half-calcined raw material in the primary deposited layer is pushed out toward the drop port 8A from the vicinity of the lower portion of the lower free surface 39, and is allowed to drop. The hearth 8 rotates about a vertical central axis, and the primary deposited layer on the hearth 8 also rotates as a result. However, since the pushers 22A are supported by the outer hollow cylindrical portion 3 fixed in the space, and does not move in the circumferential direction and reciprocates only in the radial direction, the pushers 22A are capable of uniformly pushing out the primary deposited layer of the raw material which relatively moves in the circumferential direction.

The raw material which is half-calcined in the primary deposited layer on the rotating hearth 8 drops from the drop port 8A in the central portion of the hearth from the lower free surface 39 side by the action of the pushers 22A, and forms a secondary deposited layer in the kiln body 10. Since the diffuser 12 is disposed in the central portion of the kiln body 10, the secondary deposited layer in the kiln body 10 is formed in an annular shape around the diffuser 12, and an upper free surface 40 is formed on the outer periphery in the the vicinity of an upper end of the diffuser 12, while a lower free surface 41 is formed around the ejector on the lower end side of the diffuser 12. Since the kiln body 10 is integrally connected to the rotating hearth 8, the kiln body 10 rotates together with the hearth 8.

(6) The air which is pressurized outside passes through the rotary joint 18 and reaches the heat exchanger 16, where the air is heated by the heat from the surrounding secondary deposited layer in the kiln body 10, and is ejected upward from the ejector 14 toward the diffuser 12. As the air is ejected at high speed from the ejector 14, the pressure in the region of the lower free surface 41 formed around the ejector 14 declines, with the result that part of the high-temperature combustion gas in the combustion chamber 21 actively flows through the interior of the secondary deposited layer from the upper free surface 40 toward the lower free surface 41 of the secondary deposited layer, thereby effectively completing the subsequent calcination of the half-calcined raw material. Incidentally, the type and dimensions of the aforementioned heat exchanger 16 and the number of such heat exchangers are arbitrary. In addition, the heat exchanger may not be used.

(7) The calcination-completed material in the secondary deposited layer in the kiln body 10 is discharged from the discharge port 20 in the form of products. At that time, the raw material is cooled by the heat exchanger 16 and the air which passes through the particles of the raw material from the discharge port 20 and flows into the kiln body 10, and its temperature is thereby lowered. Subsequently, the raw material is discharged outside from the discharge port 20 by the action of the relative rotation between the fixed bottom plate 19 and the kiln body 10. The discharging mechanism in this case may not necessarily be restricted to the one shown in FIG. 1, and may be arbitrary.

(8) In this embodiment, the combustion gas, whose temperature has dropped after the combustion gas heated the raw material while flowing upward through the primary deposited layer of the raw material formed in the preheating space 22, passes through the combustion-gas introducing pipe 27 and is sent to the heat exchanger 28. Meanwhile, the combustion air taken in from the outside by means of the air blower 29 is sent to the aforementioned heat exchanger 28 where the combustion air is preheated by undergoing heat exchange with the combustion gas, and the combustion air is sent through the combustion-air supplying pipe 6 and is jetted in the vicinity of the tip of the burner 5 so as to burn the fuel.

(9) The combustion gas whose temperature has dropped after the combustion gas left the heat exchanger 28 is released to the atmosphere via the blower 32 in a state in which its dust is eliminated by the dust collector 31 and the combustion gas is thereby cleaned. Part of the combustion gas is fed back and supplied into the combustion chamber 21 by the operation of the blower 33. At that time, the method of supplying the combustion gas is not restricted to the one shown in FIG. 1, and the position, type and dimensions of the heat exchanger and the number of such heat exchangers are arbitrary. The arrangement is not restricted to the one in which the combustion gas and the combustion air are supplied separately as described above. For instance, the combustion gas may be mixed with the air in the combustion-air supplying pipe 6 and may be supplied to the combustion chamber 21 by closing the valve 37 and opening the valve 35. As part of the combustion gas is thus fed back to the combustion chamber 21, the concentration of carbon dioxide which is emitted to the outside can be controlled. That is, the concentration of carbon dioxide in the combustion chamber 21 can be controlled to a predetermined value, and the calcination of the raw material can be improved.

(10) If solid combustibles in powder and granular form and in pieces, such as petroleum coke including coarse particles, powdery coal, crushed plastic pieces, crushed plant and wood pieces, are also to be used as fuel, the solid combustibles in powder and granular form and in pieces are supplied from any or all of a solid-fuel supplying port 42 provided in the kiln cover 1, the solid-fuel supplying port 30 provided in the combustion-air supplying pipe 6, and a solid-fuel supplying port 43 provided at a position downstream of the blower 33. The positions, dimensions, and number of the solid-fuel supplying ports are arbitrary.

Figure 2:
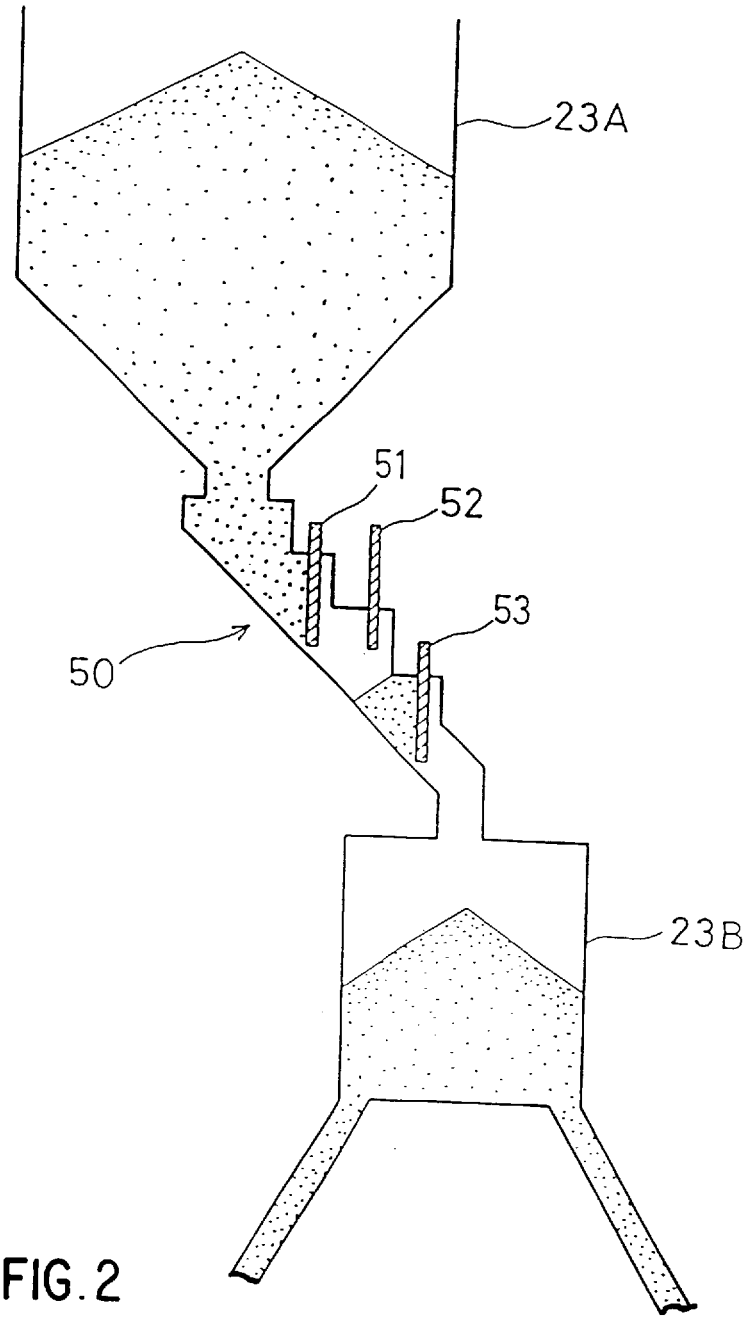
FIG. 2 is a vertical cross-sectional view illustrating a modification of an airtight supplying mechanism applicable to the apparatus shown in FIG. 1.

In the apparatus shown in FIG. 1, the airtight supplying mechanism disposed between the upper storage device 23A and the lower storage device 23B may not necessarily be restricted to the illustrated rotary valve, and a three-stage damper 50 shown in FIG. 2 may be used. FIG. 2 shows the basic principle of the three-stage damper. This three-stage damper is provided with three gate plates 51, 52, and 53 in a passage connecting the upper storage device 23A and the lower storage device 23B. If, in the illustrated state, the gate plate 52 is closed and the gate plate 53 is opened, a fixed quantity of raw material which was blocked by the gate plate 53 in FIG. 2 drops into the lower storage device 23B while maintaining the airtightness. Insofar as a supplying method based on such a basic principle is used, the type and dimensions of the three-stage damper and the number of such gate plates are arbitrary.

Figure 3:
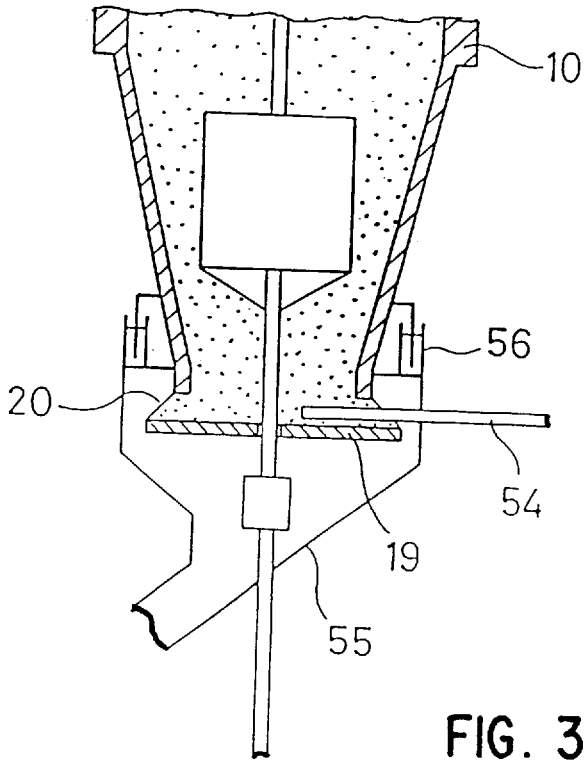
FIG. 3 is a vertical cross-sectional view illustrating a modification of a discharge port and its vicinities of a kiln body applicable to the apparatus shown in FIG. 1.

In addition, the discharging of calcination-completed products from the discharge port 20 is not restricted to the type shown in FIG. 1. For instance, as shown in FIG. 3, a non-rotating discharge rod 54 may be provided at the discharge port 20 so as to accelerate the dropping of products dropping from the discharge port 20 by means of the relative rotation between the kiln body 10 and the bottom plate 19. In that case, if a sealing device 56, such as a water seal, is provided between a discharge chute 55 and the kiln body 10, the leakage of air is prevented by the sealing device 56, thereby making it possible to effectively perform the charging of air under pressure through the discharge port 20.

Second Embodiment

Figure 4:
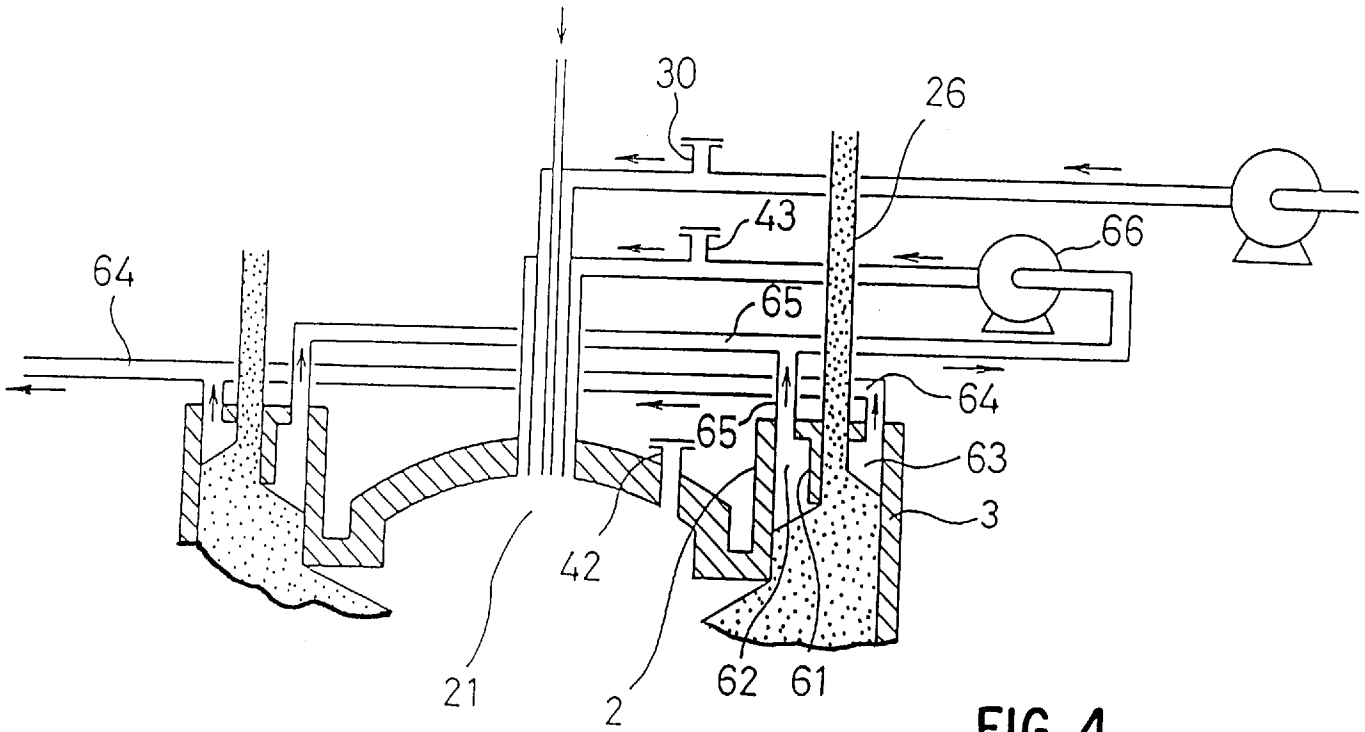
FIG. 4 is a vertical cross-sectional view of the apparatus in accordance with a second embodiment of the present invention.

In FIG. 4, a hollow-cylindrical partition wall 61 is provided between the outer hollow cylindrical portion 3 and the inner hollow cylindrical portion 2 which form the primary deposited layer of raw material on the hearth, in such a manner as to extend downward to an intermediate position so as to divide the upper portion of the preheating space into an inner space 62 and an outer space 63, whereby the upper portion of the primary deposited layer is annularly divided into two portions which are present in the inner space 62 and the outer space 63, thereby allowing the combustion gas discharged from the vicinities of lower ends of the raw-material supplying pipes 26 to be discharged to outside the kiln via a combustion-gas introducing pipe 64. The remaining combustion gas with its temperature remaining high as it is is collected by a combustion-gas introducing pipe 65 connected to the inner space 62, and is fed back and supplied into the combustion chamber 21 by the operation of a circulating blower 66. At that time, the solid-fuel supplying ports 30, 42, and 43 operate in the same way as in the first embodiment.

Figure 5:
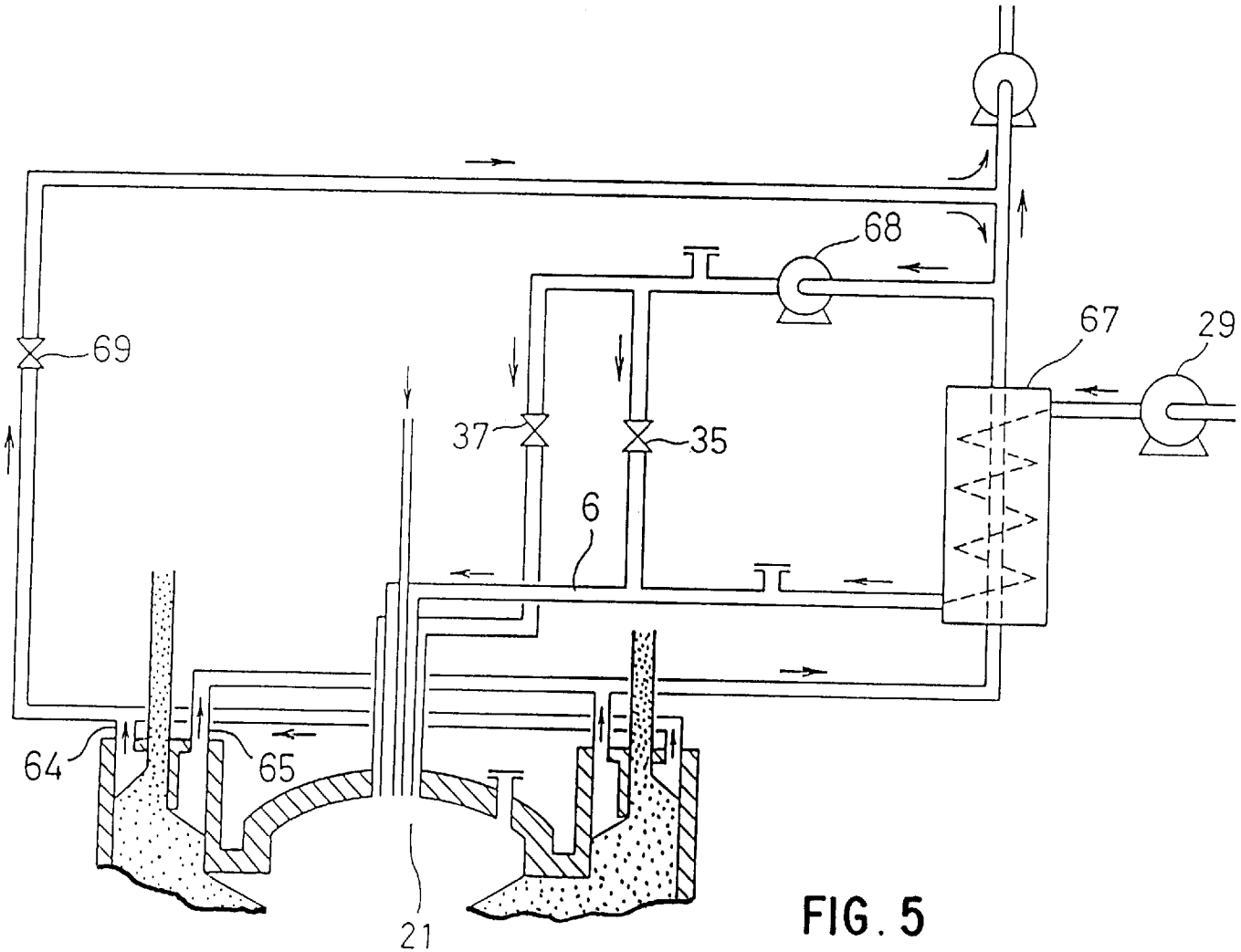
FIG. 5 is a vertical cross-sectional view of a modification of the combustion gas piping of the apparatus shown in FIG. 4.

The high-temperature gas collected by the combustion-gas introducing pipe 65 may not necessarily be induced as it is by the blower 66 in FIG. 4. For example, after the temperature of the combustion gas itself is lowered through a heat exchanger 67 as shown in FIG. 5, the combustion gas may be supplied into the combustion chamber 21 by the operation of a circulating blower 68. By adopting such an arrangement, the air in the combustion-air supplying pipe 6 supplied by the circulating blower 29 is preheated with its temperature raised, and burns the fuel with high thermal efficiency. In addition, by closing the valve 37 and opening the valve 35, part of the combustion gas may be mixed with the combustion air, and may be supplied into the combustion chamber 21.

A valve 69 in FIG. 5 is used for adjustment so as to distribute the combustion gas into the two combustion-gas introducing pipes. That is, if the valve 69 is adjusted in the direction in which it is closed, the amount of the combustion gas which flows into the combustion-gas introducing pipe 64 is reduced, and the amount of the combustion gas which flows into the combustion-gas introducing pipe 65 leading to the heat exchanger 67 increases.

Figure 6:
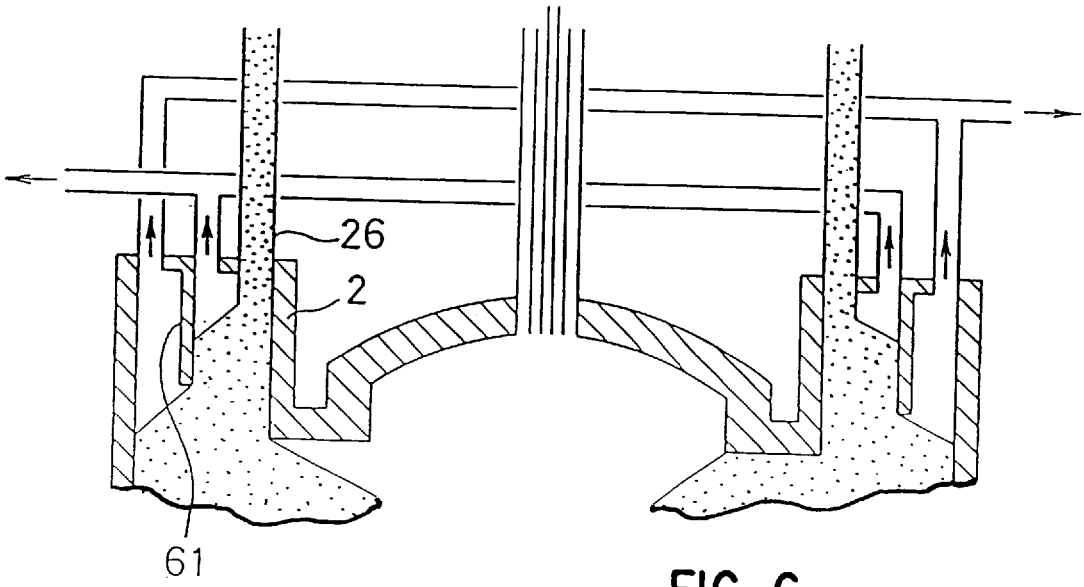
FIG. 6 is a vertical cross-sectional view of another modification of the combustion gas piping of the apparatus shown in FIG. 4.

The method in which the partition wall 61 for dividing the upper region of the primary deposited layer of the raw material on the hearth annularly into two portions is installed is not necessarily confined to the one shown in FIGS. 4 and 5. For example, the raw-material supplying pipes 26 may be installed at positions offset toward the inner hollow cylindrical portion 2, as shown in FIG. 6.

Third Embodiment

Figure 7:
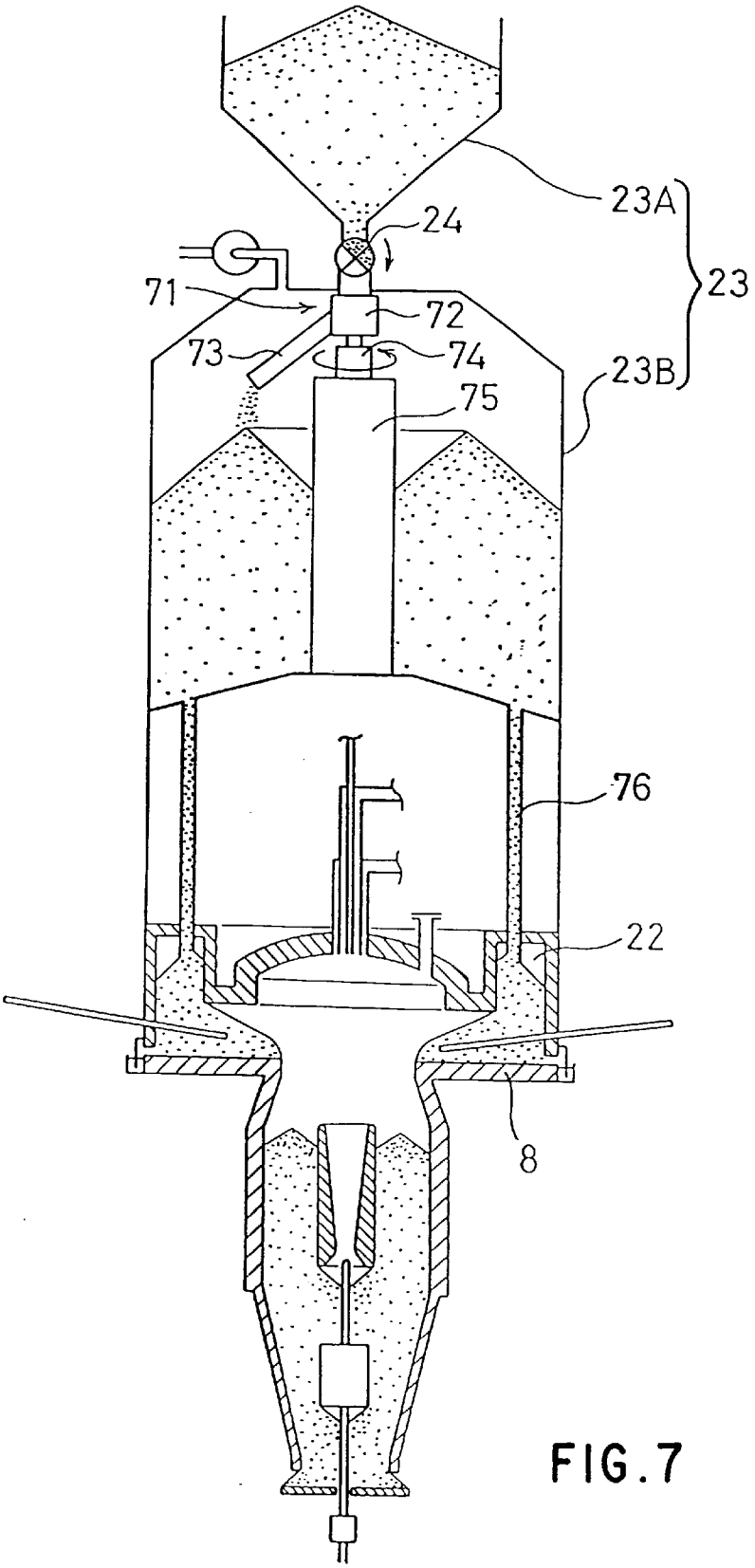
FIG. 7 is a vertical cross-sectional view of the apparatus in accordance with a third embodiment of the present invention.

The storage device for storing the raw material is not confined to the one shown in FIG. 1. For example, as shown in FIG. 7, in the same way as in FIG. 1, the rotary valve 24 is provided between the upper storage device 23A and the lower storage device 23B, and the inducing device 25, such as a blower, is connected to an upper portion of the lower storage device 23B. In addition to this arrangement, in this embodiment, a rotary chute 71 is further provided immediately below the rotary valve 24. The rotary chute 71 has a receiving portion 72, a chute 73, and a motor 74, and the raw material which drops from the rotary valve 24 is received by the receiving portion 72, and this raw material is allowed to drop from a lower-end port of the chute 73. The motor 74 is attached to a column 75 in the center, and is adapted to rotate the receiving portion 72 and the chute 73 connected to the receiving portion 72. The raw material which drops from the rotating chute 73 is deposited uniformly in the circumferential direction inside the lower storage device 23B. As for the raw material, there are cases where various particle sizes are unevenly distributed inside the upper storage device 23A, but in accordance with the above-described embodiment the raw material is deposited uniformly in the circumferential direction inside the lower storage device 23B, so that the raw material which drops to the hearth 8 via raw-material supplying pipes 76 forms a circumferentially uniform primary deposited layer in the preheating space 22, with the result that the half-calcination is carried out uniformly.

Fourth Embodiment

Figure 8:
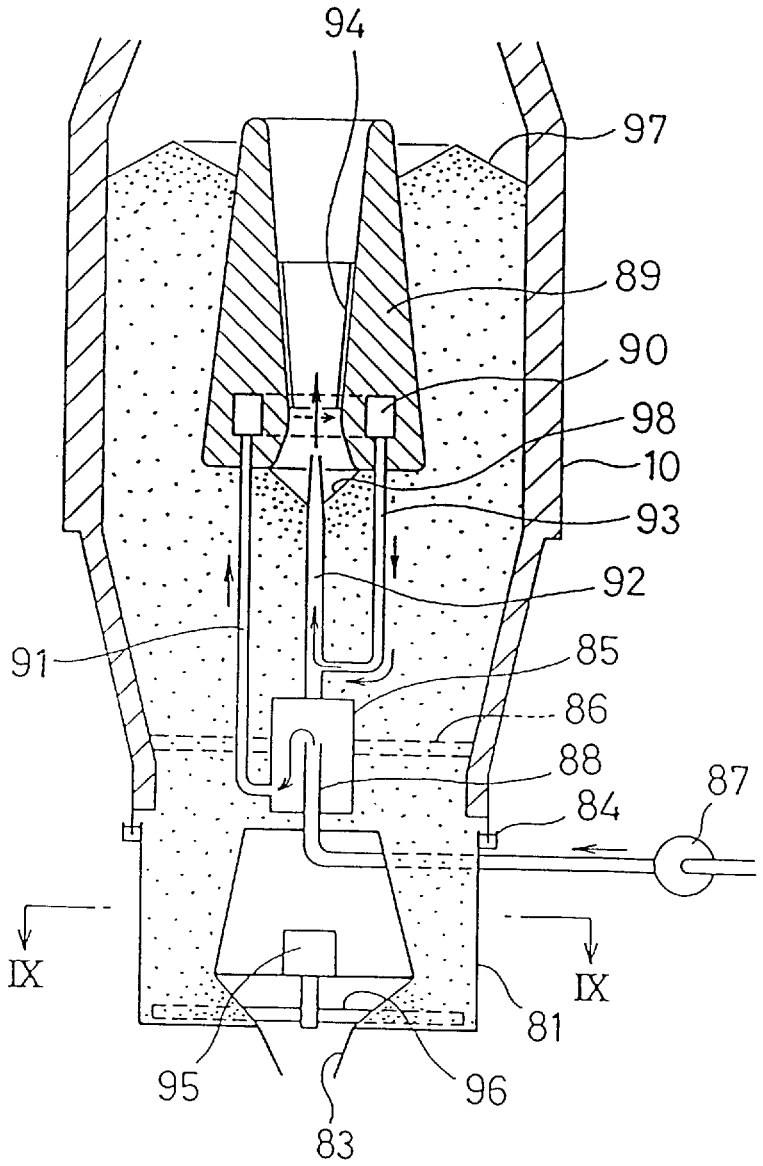
FIG. 8 is a vertical cross-sectional view of the apparatus in accordance with a fourth embodiment of the present invention.

Next, the diffuser and the ejector as well as their peripheral arrangements are not restricted to those shown in FIG. 1, and a modification is possible as in this embodiment which is shown in FIG. 8.

Figure 9:
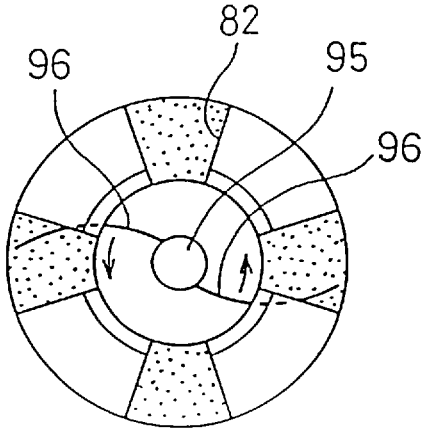
FIG. 9 is a cross-sectional view taken-along lines IX—IX in FIG. 8.

In this embodiment, a discharge cylinder 81 is provided immediately below the kiln body 10. The discharge cylinder 81 is for discharging the cooled products after calcination, and need not be formed of a heat resisting material, in particular. As its cross section is shown in FIG. 9, the discharge cylinder 81 is provided with narrow drop passages 82 at four circumferential portions. As illustrated, lower portions of the narrow drop passages 82 are open radially inwardly, and communicate with a discharge port 83. The discharge cylinder 81 does not rotate, and allows relative rotation with respect to the kiln body 10 by means of the sealing device 84 such as a water seal between the discharge cylinder 81 and the kiln body 10.

A rotary joint 85 is supported at a position above the discharge cylinder 81 by means of a supporting portion 86 of the kiln body 10. The rotary joint 85 has a closed hollow cylindrical shape, and an air supplying pipe 88 for suppling air from the outside by means of a blower 87 projects into the rotary joint 85 in such a manner as to permit the rotation of the rotary joint 85 in a state in which the air supplying pipe 88 is sealed.

A diffuser 89 has substantially the same outer shape as the one shown in FIG. 1, but an annular space 90 is formed therein in its lower portion, and a portion of the annular space 90 and a side portion of the rotary joint 85 are connected to each other by a first pipeline 91, and hence communicate with each other. An ejector 92 is installed on the rotary joint 85 in such a manner as to project uprightly. The ejector 92 and another portion of the annular space 90 are connected to each other by means of a second pipeline 93, and hence communicate with each other.

The air-supplying duct 13 which expands toward its upper portion in a tapered manner is formed in the diffuser 89. A conical protective pipe 94, which substantially matches the taper and is formed of a heat resisting metal plate, is fitted in the air-supplying duct 13 in such a manner as to be capable of being mounted or demounted from above.

A motor 95 is provided in a central space of the discharge cylinder 81, and rotates a wing body 96 which extends radially outwardly while curving. The wing body 96 rotates in close proximity to the bottom surface of the discharge cylinder 81.

In the above-described embodiment, the air which is taken in by the blower 87 is heated by heat exchange with the calcined material in the surroundings while passing through the first pipeline 91, the annular space 90, and the second pipeline 93, and its temperature is hence raised. This air in the high-temperature state is ejected from the ejector 92, and the heat is effectively utilized. In addition, since this heat exchange is effected at a position below the region where the raw material is sufficiently calcined, so that there is an advantage in that the cooling of the products which are discharged is promoted.

In the discharge cylinder 81, since the products are discharged through the narrow drop passages 82, the internal resistance in the narrow drop passages 82 becomes greater than the internal resistance at the time when the combustion gas in the combustion chamber flows from an upper free surface 97 of the secondary deposited layer into the secondary deposited layer. Therefore, the combustion gas which has flowed from the upper free surface 97 into the secondary deposited layer actively forms a circulating current which flows toward a lower free surface 98 in the vicinity of an ejection port of the ejector 92, thereby facilitating the calcination in an upper portion of the secondary deposited layer and reducing the influx of air from the discharge port 83 to a very small degree.

Further, even if dust adheres to the protective pipe 94, the adherents can easily exfoliate and drop due to the difference in the coefficient of thermal expansion between the protective pipe 94 and the diffuser 89. Even if the adherents remain in small quantities, the protective pipe 94 can be taken out upwardly, and can be cleaned. As such, the shape and surface of the air-supplying duct in the diffuser 89 can be maintained in a proper state, so that the function of the diffuser can be maintained.

If the apparatus of this embodiment, in which the diffuser and the discharge cylinder having narrow drop passages at a position below the ejector are provided, is combined with the airtight supplying mechanism of the apparatus of the first embodiment so as to constitute the calcination kiln, it is possible to prevent the leakage and influx of the outside air from both the raw-material supplying side and the product discharging side, thereby making it possible to increase the concentration of carbon dioxide discharged and to enhance the thermal efficiency in the diffuser.

As described above, in accordance with the present invention, since it is possible to prevent the leakage and influx of air from the outside, and it is unnecessary to supply a large amount of excess air for adjusting the temperature of the combustion chamber, it is possible to lower the temperature of the combustion gas discharged from the calcination kiln. Accordingly, it is possible to lower the fuel consumption rate and increase the concentration of carbon dioxide in the combustion gas. In addition, since combustibles in powder and granular form and in pieces, including solid wastes, can be used as effective fuel, the fuel cost can be reduced substantially. Furthermore, it is possible to properly maintain the function of the diffuser by the use of the protective pipe.

What is claimed is:

1. A vertical type calcination kiln comprising an annular hearth adapted to rotate about a vertical axis and having in a central portion thereof a drop port for dropping a raw material; and a kiln cover disposed fixedly at a position above said hearth, wherein an inner hollow cylindrical portion having an outside diameter larger than a diameter of said drop port and provided continuously from said kiln cover, and an outer hollow cylindrical portion connected at an upper portion thereof to said inner hollow cylindrical portion are provided around said kiln cover, said outer hollow cylindrical portion being formed in such a manner as to extend more downwardly than said inner hollow cylindrical portion, a fuel supplying sort being provided in said kiln cover for supplying a fuel from the outside into a combustion chamber formed immediately below said kiln cover, a sealing device which is airtight with the outside being provided between said hearth and a lower end of said outer hollow cylindrical portion so as to permit relative rotation of said hearth with respect to said kiln cover, a raw-material supplying pipe being provided in an annular preheating space formed by being surrounded by said hearth and said inner hollow cylindrical portion and said outer hollow cylindrical portion connected to each other at upper portions thereof so as to dropwise supply the raw material from the outside into said preheating space, said preheating space being open radially inwardly so as to communicate with said combustion chamber, a kiln body of a vertical hollow cylindrical shape being provided in such a manner as to extend downward from a rim portion of said drop port formed in the central portion of said hearth, the raw material in said preheating space being adapted to drop from a side facing said combustion chamber, a discharge port being formed in a lower portion of said kiln body for discharging as a product the raw material calcined in said kiln body after being dropped from said drop port, said vertical type calcination kiln characterized in that a storage device for storing the raw material to be calcined is provided at a position above said kiln cover, that said storage device is connected to said preheating space in such a manner as to be capable of dropwise supplying the raw material into said preheating space by means of said raw-material supplying pipe, and that an airtight supplying mechanism for dropwise supplying the raw material in a state in which the influx of air from the outside is prevented is provided between said storage device and said raw-material supplying pipe, wherein an upper portion of said preheating space and said combustion chamber are connected to each other by a combustion-gas introducing pipe for forming a feedback passage whereby part of a combustion gas flowing through the raw material in said preheating space and exhausted upward can be fed back to said combustion chamber.

2. A vertical type calcination kiln according to claim 1, wherein said airtight supplying mechanism is a rotary valve.

3. A vertical type calcination kiln according to claim 2, wherein said storage device has an upper storage device and a lower storage device, and said airtight supplying mechanism is provided between said upper storage device and said lower storage device.

4. A vertical type calcination kiln according to claim 1, wherein an upper space of said preheating space is divided into an inner space and an outer space by means of a hollow cylindrical partitioning wall which is suspended downward between said inner hollow cylindrical portion and said outer hollow cylindrical portion to an intermediate position in said preheating space, and said raw-material supplying pipe is connected to one of said inner space and said outer space, while said combustion-gas introducing pipe is connected to another one thereof.

5. A vertical type calcination kiln according to claim 4, wherein a combustion-air supplying pipe for receiving air for combustion from the outside is connected to said combustion chamber, and said combustion-air supplying pipe is connected to said combustion chamber via a heat exchanger whereby the air in said combustion-air supplying pipe undergoes heat exchange with the combustion gas in said combustion-gas introducing pipe.

6. A vertical type calcination kiln according to claim 4, wherein a solid-fuel supplying port capable of supplying a solid combustible substance into said combustion chamber is provided in at least one of said combustion chamber and a combustion-gas supplying pipe.

7. A vertical type calcination kiln according to claim 1, wherein a combustion-air supplying pipe for receiving air for combustion from the outside is connected to said combustion chamber, and said combustion-air supplying pipe is connected to said combustion chamber via a heat exchanger whereby the air in said combustion-air supplying pipe undergoes heat exchange with the combustion gas in said combustion-gas introducing pipe.

8. A vertical type calcination kiln according to claim 1, wherein said storage device is provided with an inducing device disposed below said airtight supplying mechanism so as to induce the air in said storage device toward the outside.

9. A vertical type calcination kiln according to claim 1, wherein a solid-fuel supplying port capable of supplying a solid combustible substance into said combustion chamber is provided in at least one of said combustion chamber and a combustion-gas supplying pipe.

10. A vertical type calcination kiln according to claim 1, wherein said storage device has below said airtight supplying mechanism a rotary chute which rotates about the vertical axis, and an inlet side of said rotary chute is disposed at a position for receiving the raw material dropping from said airtight supplying mechanism arranged on the vertical axis, while an outlet side thereof is disposed at a position offset radially outwardly of at least the vertical axis.

11. A vertical type calcination kiln comprising an annular hearth adapted to rotate about a vertical axis and having in a central portion thereof a drop port for dropping a raw material; and a kiln cover disposed fixedly at a position above said hearth, wherein an inner hollow cylindrical portion having an outside diameter larger than a diameter of said drop port and provided continuously from said kiln cover, and an outer hollow cylindrical portion connected at an upper portion thereof to said inner hollow cylindrical portion are provided around said kiln cover, said outer hollow cylindrical portion being formed in such a manner as to extend more downwardly than said inner hollow cylindrical portion, a fuel supplying port being provided in said kiln cover for supplying a fuel from the outside into a combustion chamber formed immediately below said kiln cover, a sealing device which is airtight with the outside being provided between said hearth and a lower end of said outer hollow cylindrical portion so as to permit relative rotation of said hearth with respect to said kiln cover, a raw-material supplying pipe being provided in an annular preheating space formed by being surrounded by said hearth and said inner hollow cylindrical portion and said outer hollow cylindrical portion connected to each other at upper portions thereof so as to dropwise supply the raw material from the outside into said preheating space, said preheating space being open radially inwardly so as to communicate with said combustion chamber, a kiln body of a vertical hollow cylindrical shape being provided in such a manner as to extend downward from a rim portion of said drop port formed in the central portion of said hearth, the raw material in said preheating space being adapted to drop from a side facing said combustion chamber, a discharge port being formed in a lower portion of said kiln body for discharging as a product the raw material calcined in said kiln body after being dropped from said drop port, said vertical type calcination kiln characterized in that a storage device for storing the raw material to be calcined is provided at a position above said kiln cover, that said storage device is connected to said preheating space in such a manner as to be capable of dropwise supplying the raw material into said preheating space by means of said raw-material supplying pipe, and that an airtight supplying mechanism for dropwise supplying the raw material in a state in which the influx of air from the outside is prevented is provided between said storage device and said raw-material supplying pipe, wherein a solid-fuel supplying port capable of supplying a solid combustible substance into said combustion chamber is provided in at least one of said combustion chamber and a combustion-gas supplying pipe.

12. A vertical type calcination kiln according to claim 11, wherein said storage device is provided with an inducing device disposed below said airtight supplying mechanism so as to induce the air in said storage device toward the outside.

13. A vertical type calcination kiln comprising an annular hearth adapted to rotate about a vertical axis and having in a central portion thereof a drop port for dropping a raw material; and a kiln cover disposed fixedly at a position above said hearth, wherein an inner hollow cylindrical portion having an outside diameter larger than a diameter of said drop port and provided continuously from said kiln cover, and an outer hollow cylindrical portion connected at an upper portion thereof to said inner hollow cylindrical portion are provided around said kiln cover, said outer hollow cylindrical portion being formed in such a manner as to extend more downwardly than said inner hollow cylindrical portion, a fuel supplying port being provided in said kiln cover for supplying a fuel from the outside into a combustion chamber formed immediately below said kiln cover, a sealing device which is airtight with the outside being provided between said hearth and a lower end of said outer hollow cylindrical portion so as to permit relative rotation of said hearth with respect to said kiln cover, a raw-material supplying pipe being provided in an annular preheating space formed by being surrounded by said hearth and said inner hollow cylindrical portion and said outer hollow cylindrical portion connected to each other at upper portions thereof so as to dropwise supply the raw material from the outside into said preheating space, said preheating space being open radially inwardly so as to communicate with said combustion chamber, a kiln body of a vertical hollow cylindrical shape being provided in such a manner as to extend downward from a rim portion of said drop port formed in the central portion of said hearth, the raw material in said preheating space being adapted to drop from a side facing said combustion chamber, a discharge port being formed in a lower portion of said kiln body for discharging as a product the raw material calcined in said kiln body after being dropped from said drop port, said vertical type calcination kiln characterized in that a storage device for storing the raw material to be calcined is provided at a position above said kiln cover, that said storage device is connected to said preheating space in such a manner as to be capable of dropwise supplying the raw material into said preheating space by means of said raw-material supplying pipe, and that an airtight supplying mechanism for dropwise supplying the raw material in a state in which the influx of air from the outside is prevented is provided between said storage device and said raw-material supplying pipe, wherein said storage device has below said airtight supplying mechanism a rotary chute which rotates about the vertical axis, and an inlet side of said rotary chute is disposed at a position for receiving the raw material dropping from said airtight supplying mechanism arranged on the vertical axis, while an outlet side thereof is disposed at a position offset radially outwardly of at least the vertical axis.

14. A vertical type calcination kiln according to claim 13, wherein said storage device has an upper storage device and a lower storage device, and said airtight supplying mechanism is provided between said upper storage device and said lower storage device.

15. A vertical type calcination kiln according to claim 13, wherein said storage device is provided with an inducing device disposed below said airtight supplying mechanism so as to induce the air in said storage device toward the outside.

16. A vertical type calcination kiln comprising an annular hearth adapted to rotate about a vertical axis and having in a central portion thereof a drop port for dropping a raw material; and a kiln cover disposed fixedly at a position above said hearth, wherein an inner hollow cylindrical portion having an outside diameter larger than a diameter of said drop port and provided continuously from said kiln cover, and an outer hollow cylindrical portion connected at an upper portion thereof to said inner hollow cylindrical portion are provided around said kiln cover, said outer hollow cylindrical portion being formed in such a manner as to extend more downwardly than said inner hollow cylindrical portion, a fuel supplying port being provided in said kiln cover for supplying a fuel from the outside into a combustion chamber formed immediately below said kiln cover, a sealing device which is airtight with the outside being provided between said hearth and a lower end of said outer hollow cylindrical portion so as to permit relative rotation of said hearth with respect to said kiln cover, a raw-material supplying pipe being provided in an annular preheating space formed by being surrounded by said hearth and said inner hollow cylindrical portion and said outer hollow cylindrical portion connected to each other at upper portions thereof so as to dropwise supply the raw material from the outside into said preheating space, said preheating space being open radially inwardly so as to communicate with said combustion chamber, a kiln body of a vertical hollow cylindrical shape being provided in such a manner as to extend downward from a rim portion of said drop port formed in the central portion of said hearth, the raw material in said preheating space being adapted to drop from a side facing said combustion chamber, a discharge port being formed in a lower portion of said kiln body for discharging as a product the raw material calcined in said kiln body after being dropped from said drop port, said vertical type calcination kiln characterized in that a storage device for storing the raw material to be calcined is provided at a position above said kiln cover, that said storage device is connected to said preheating space in such a manner as to be capable of dropwise supplying the raw material into said preheating space by means of said raw-material supplying pipe, and that an airtight supplying mechanism for dropwise supplying the raw material in a state in which the influx of air from the outside is prevented is provided between said storage device and said raw-material supplying pipe wherein said kiln body is provided in an interior thereof with a hollow cylindrical diffuser supported by said kiln body and having an air-supplying duct formed therein in the manner of a vertically extending through duct with its inside diameter becoming greater toward its upper portion, an ejector having an ejection port facing a lower-end opening of said air-supplying duct in said diffuser so as to upwardly eject air for combustion received from the outside with respect to said air-supplying duct, and a rotary joint capable of rotating in an airtight state with respect to an air-supplying pipe for supplying the air for combustion from the outside, and wherein a circumferentially communicating annular space is formed in a hollow cylindrical wall of said diffuser, and said rotary joint has its inner space connected to a portion of the annular space of said diffuser by means of a first pipeline, while another portion of said annular space is connected to a lower portion of said ejector by means of a second pipeline.

17. A vertical type calcination kiln according to claim 16, wherein said air-supplying duct in said diffuser has an inside diameter becoming greater toward its upper portion, and a protective pipe formed of a heat resisting metal plate is disposed in said air-supplying duct in contact with an inner surface thereof.

18. A vertical type calcination kiln according to claim 16, wherein a discharge cylinder provided with narrow drop passages having an area narrower than that of a space in a cross section of said kiln body above a position of said rotary joint is provided below said kiln body between the position of said rotary joint in said kiln body and said discharge port in such a manner as to permit the rotation of said kiln body in an airtight state with respect to said kiln body.

19. A vertical type calcination kiln according to claim 16, wherein said storage device is provided with an inducing device disposed below said airtight supplying mechanism so as to induce the air in said storage device toward the outside.

* * * * *